US006726202B1

(12) United States Patent
Pai

(10) Patent No.: US 6,726,202 B1
(45) Date of Patent: Apr. 27, 2004

(54) PAPER CURRENCY RECEIVING DEVICE WITH DETACHABLE WHEEL ASSEMBLY MODULES

(75) Inventor: John Pai, Tainan (TW)

(73) Assignee: Chain Link Electronic Co., Ltd., Tainan (TW)

( * ) Notice: Subject to any disclaimer, the term of this patent is extended or adjusted under 35 U.S.C. 154(b) by 0 days.

(21) Appl. No.: 10/345,789

(22) Filed: Jan. 15, 2003

(51) Int. Cl.[7] ..... B65H 3/14
(52) U.S. Cl. ..... 271/219; 902/13
(58) Field of Search ..... 271/219; 232/1 D; 446/8; 902/13, 15; B65H 031/14

(56) References Cited

U.S. PATENT DOCUMENTS 4,765,607 A * 8/1988 Zouzoulas ..... 271/177
4,997,128 A * 3/1991 Suris ..... 232/16
2003/0038015 A1 * 2/2003 Rosello ..... 194/207

* cited by examiner

*Primary Examiner*—Donald P. Walsh
*Assistant Examiner*—Kenneth W Bower
(74) *Attorney, Agent, or Firm*—Eric K. Satermo

(57) ABSTRACT

A paper currency receiving device includes a body and two wheel assembly modules. The body has two opposed sides each, having an opening that communicates an interior of the body with outside. The body further has a bill-receiving opening in a front side thereof. The wheel assembly modules are respectively, detachably mounted to the openings of the body. Each wheel assembly module includes a plate and a wheel assembly mounted on an inner side of the plate. The wheel assembly includes a plurality of wheels and a belt mounted around the belt. The wheel assemblies feed a bill inserted into the bill-receiving opening into the interior of the body.

8 Claims, 7 Drawing Sheets

PAPER CURRENCY RECEIVING DEVICE WITH DETACHABLE WHEEL ASSEMBLY MODULES

BACKGROUND OF THE INVENTION

1. Field of the Invention

The present invention relates to a paper currency receiving device for receiving paper currency. In particular, the present invention relates to a paper currency receiving device having two wheel assembly modules that can be easily detached for easy maintenance of the wheel assemblies.

2. Description of the Related Art

A paper currency receiving device is widely used in e.g., vending machines and automated-teller machines. The paper currency receiving device includes two wheel assemblies. When a bill (or note) is inserted into a slot of the paper currency receiving device, the wheel assemblies fed the bill into an interior of the paper currency receiving device by means of friction. The belt of each wheel assembly is apt to be dirtied or even damaged by alien articles stuck on the bill. Further, the belt of each wheel assembly becomes loosened after a period of time and thus causes malfunction. Thus, the belt must be periodically cleaned or replaced to ensure smooth operation of the paper currency receiving device. However, a worker must dismantle the whole paper currency receiving device for maintenance. It is, therefore, an unfulfilled need in a paper currency receiving device that allows easy maintenance of the wheel assemblies.

SUMMARY OF THE INVENTION

An object of the present invention is to provide a paper currency receiving device having two wheel assembly modules that can be easily detached for easy maintenance of the wheel assemblies.

A paper currency receiving device in accordance with the present invention includes a body and two wheel assembly modules. The body has two opposed sides each having an opening that communicates an interior of the body with outside. The body further has a bill-receiving opening in a front side thereof. The wheel assembly modules are respectively, detachably mounted to the openings of the body. Each wheel assembly module includes a plate and a wheel assembly mounted on an inner side of the plate. The wheel assembly includes a plurality of wheels and a belt mounted around the belt. The wheel assemblies feed a bill inserted into the bill-receiving opening into the interior of the body. The wheel assembly modules 4 of the paper currency receiving device in accordance with the present invention can be easily detached from the body 2 of the paper currency receiving device for maintenance when desired. Thus, the wheel assembly 4 including the belt 41 can be cleaned or replaced when necessary. The risk of malfunction is thus reduced.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
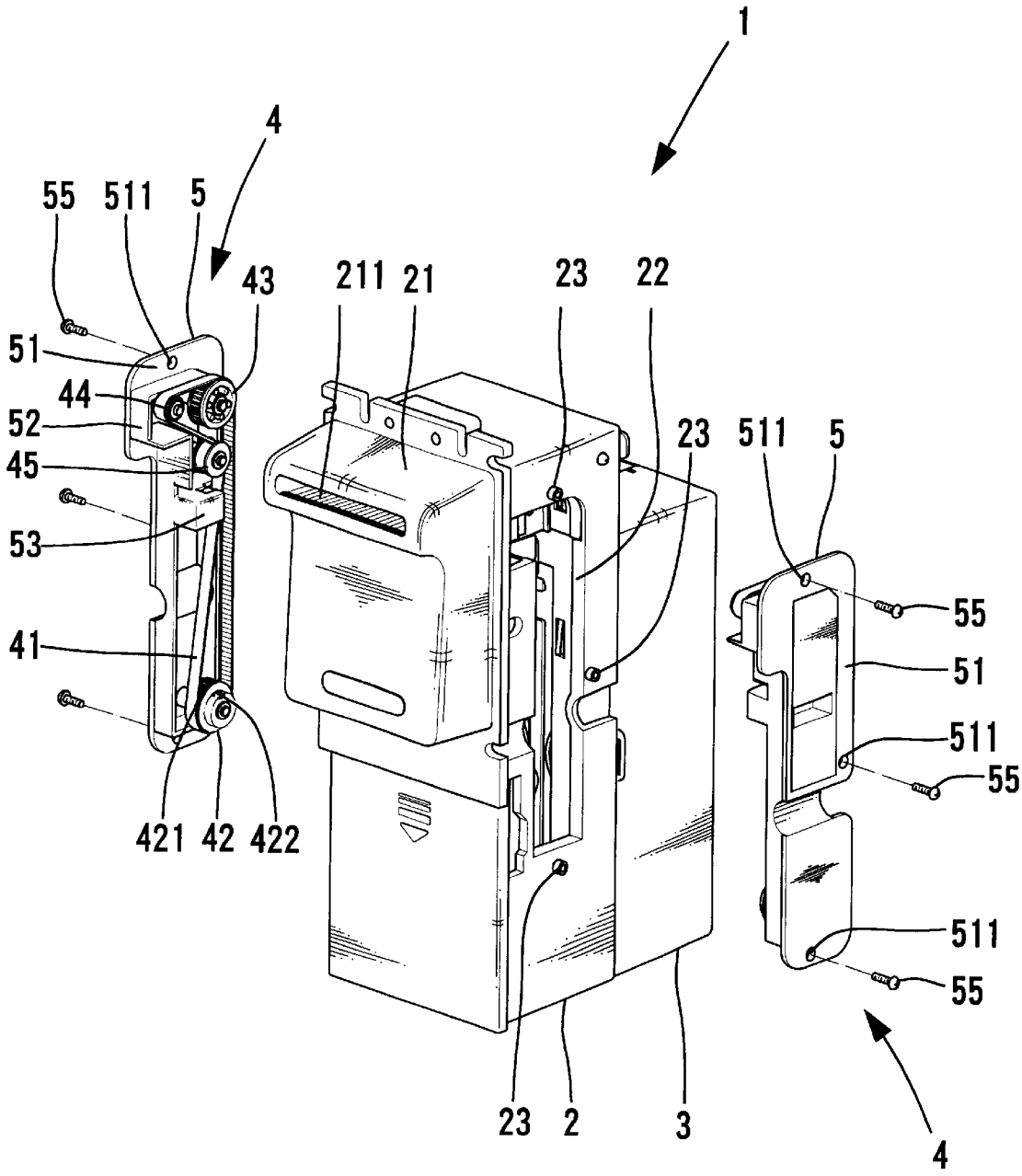
FIG. 1 is a perspective view, partly exploded, of a paper currency receiving device in accordance with the present invention.
Figure 4:
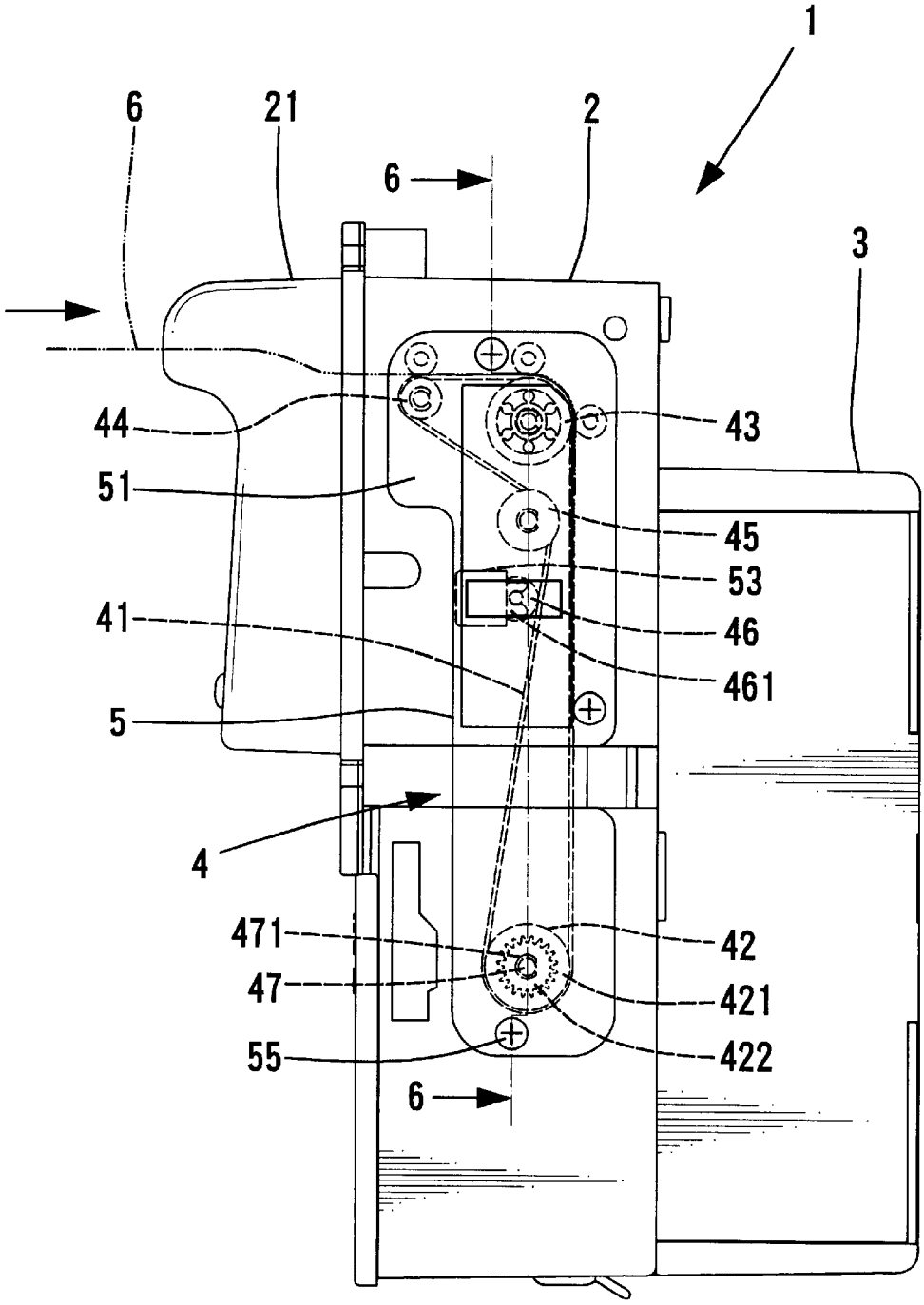
FIG. 4 is a side view illustrating operation of the paper currency receiving device in accordance with the present invention.
Figure 7:
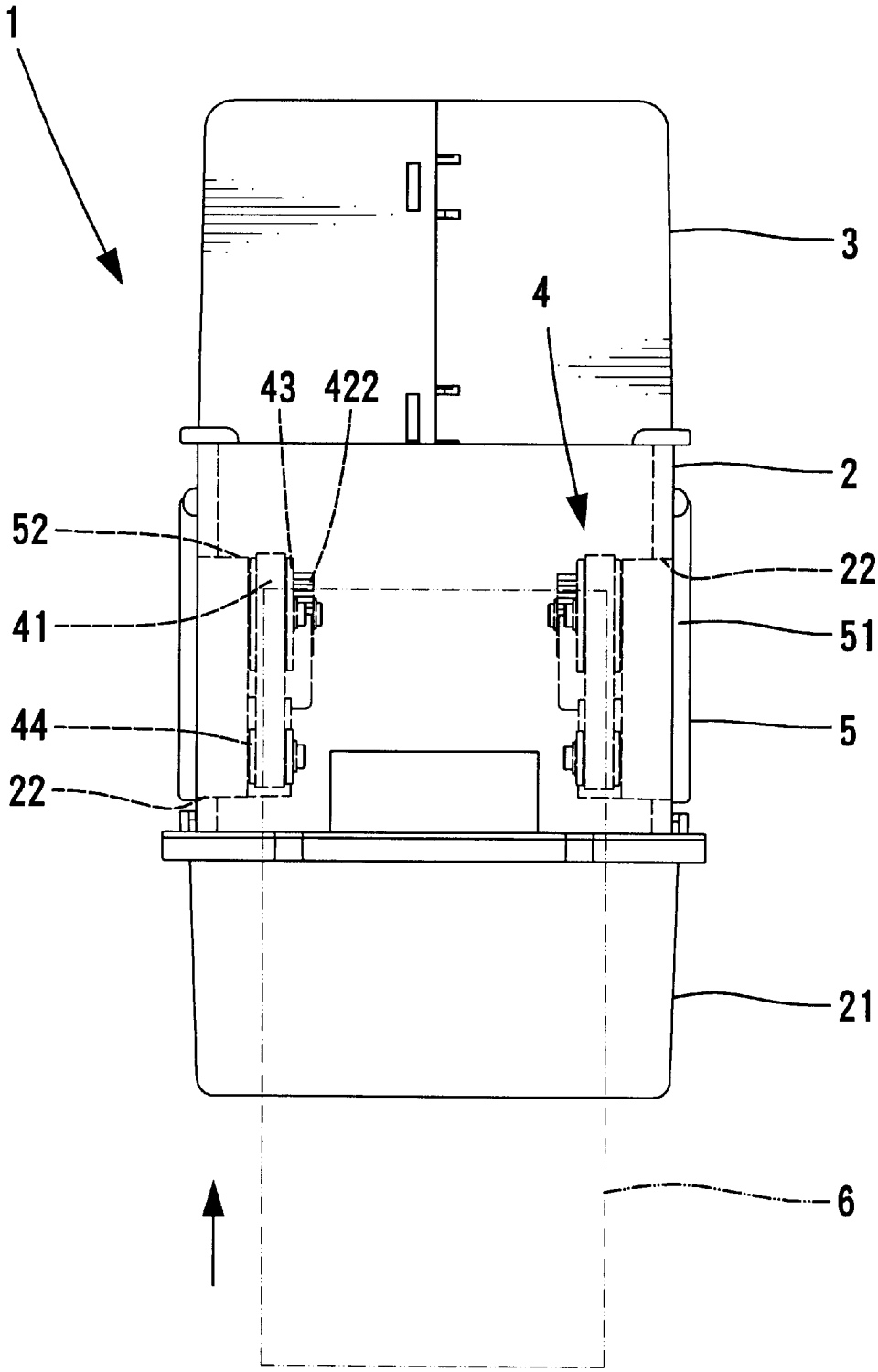
FIG. 7 is a top view illustrating operation of the paper currency receiving device in accordance with the present invention.

Referring to FIG. 1, a paper currency receiving device in accordance with the present invention is designated by "1" and generally comprises a body 2 and two wheel assembly modules 4 respectively, detachably attached to two opposed sides of the body 2. Each side of the body 2 includes a substantially inverted L-shaped opening 22 that communicates an interior of the body 2 with the outside. The openings 22 are symmetrically defined in the sides of the body 2. A front cover 21 is mounted to a front end of the body 2 and includes a bill-receiving opening 211 communicated with the interior of the body 2. Referring to FIGS. 1, 4, and 7, a bill 6 may be inserted into the body 2 via the bill-receiving opening 211. A box 3 is mounted to a rear of the body 2 for receiving the bill 6 fed by the wheel assembly modules 4 into the interior of the body 2. A plurality of pegs 23 are provided on each side of the body 2 and adjacent to the opening 22.

Figure 2:
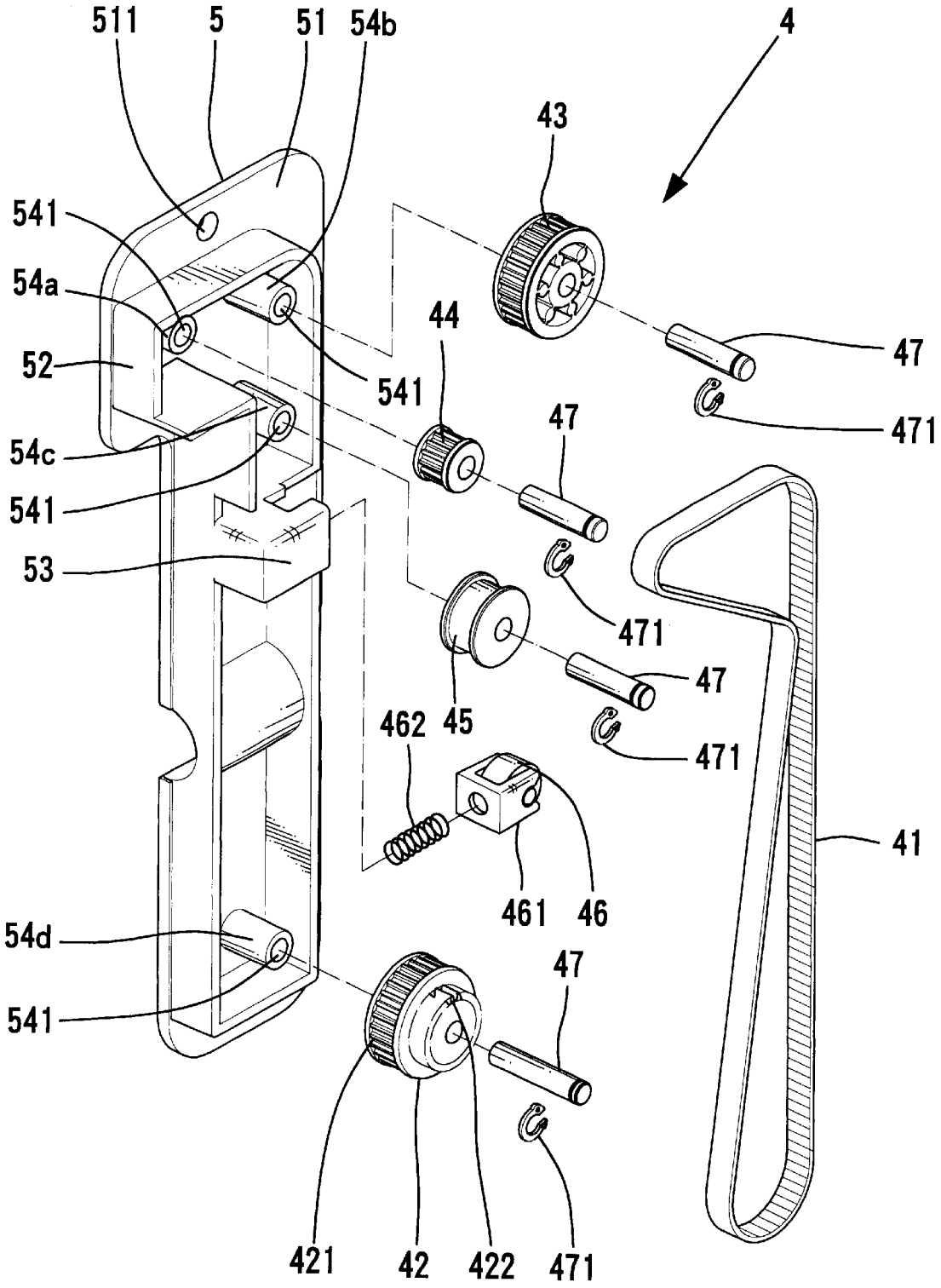
FIG. 2 is an exploded perspective view of a wheel assembly module of the paper currency receiving device in accordance with the present invention.

Referring to FIGS. 1 and 2, each wheel assembly module 4 includes a plate 5, a drive wheel 42 rotatably mounted to an inner side of the plate 5 and a wheel assembly. In this embodiment, the wheel assembly including two guide wheels 43 and 44 rotatably mounted to the inner side of the plate 5, a tensioning wheel 45 rotatably mounted to the inner side of the plate 5, and a belt 41 mounted around the wheels 42, 43, 44, and 45, with the tensioning wheel 45 exerting a tensioning force on the belt 41.

The plate 5 of each wheel assembly module 4 includes an engaging wall 52 that is substantially inverted L-shaped so as to be fitted into the associated inverted L-shaped opening 22 of the body 2. The wheel assembly is mounted inside and thus protected by the respective engaging wall 52. A plurality of holes 511 are defined in a peripheral portion 51 of the respective plate 5. Screws 55 are extended through the holes 511 of the respective plate 5 into screw holes (not labeled) of the pegs 23 on the respective side of the body 2, thereby detachably mounting the respective wheel assembly module 4 to the respective side of the body 2. Thus, the wheel assembly on the respective plate 5 is located in the interior of the body 2 for feeding the bill 6 inward.

Figure 6:
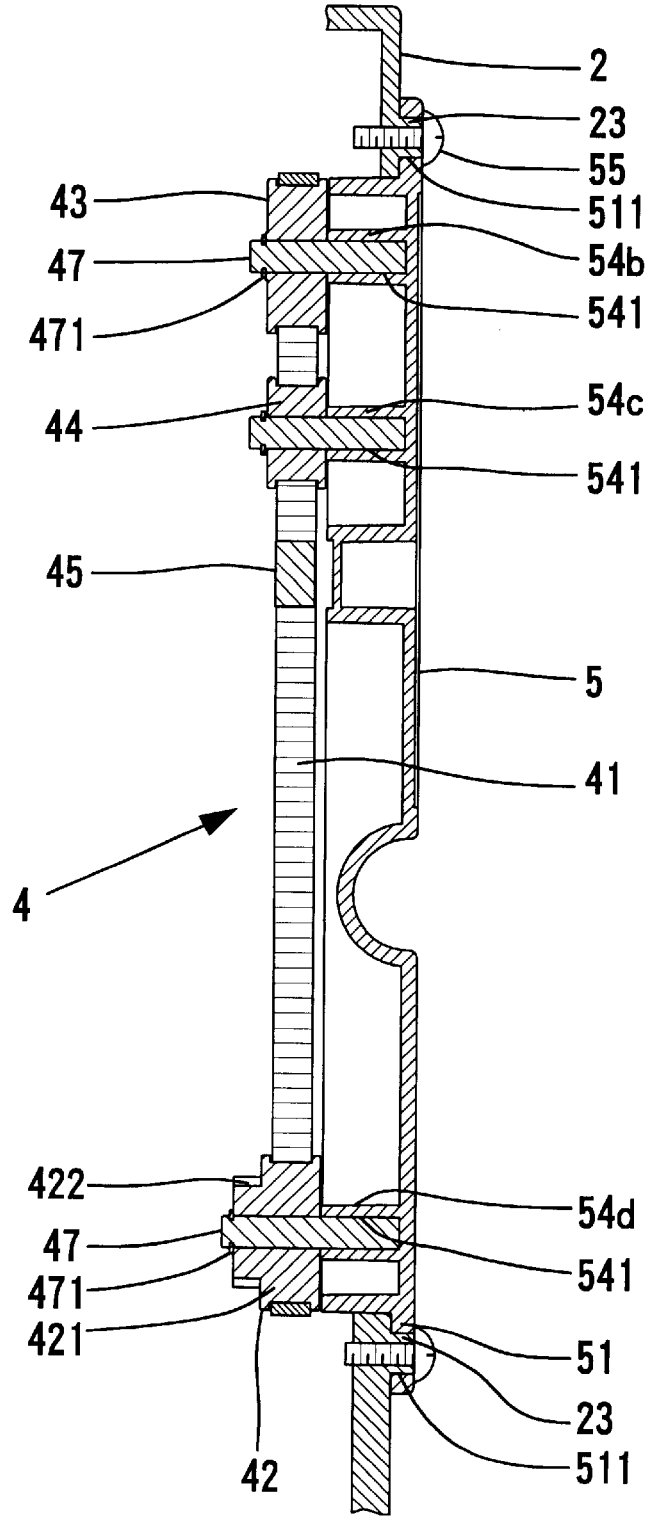
FIG. 6 is a sectional view taken along plane 4—4 in FIG. 4.

Referring to FIGS. 2 and 6, in this embodiment, each plate 5 has four pegs 54*a*, 54*b*, 54*c*, and 54*d* formed on the inner side thereof. Four axles 47 are provided and each is inserted into a hole 541 in an associated peg 54*a*, 54*b*, 54*c*, 54*d*. Each wheel 42, 43, 44, 45 is rotatably mounted around a portion of the associated axle 47 exposed outside the associated peg 54*a*, 54*b*, 54*c*, 54*d*. A retainer, e.g., a C-clip 471 is engaged in an annular groove (not labeled) in each axle 47 to thereby prevent the associated wheel 42, 43, 44, and 45 from being disengaged from the respective axle 47.

Figure 5:
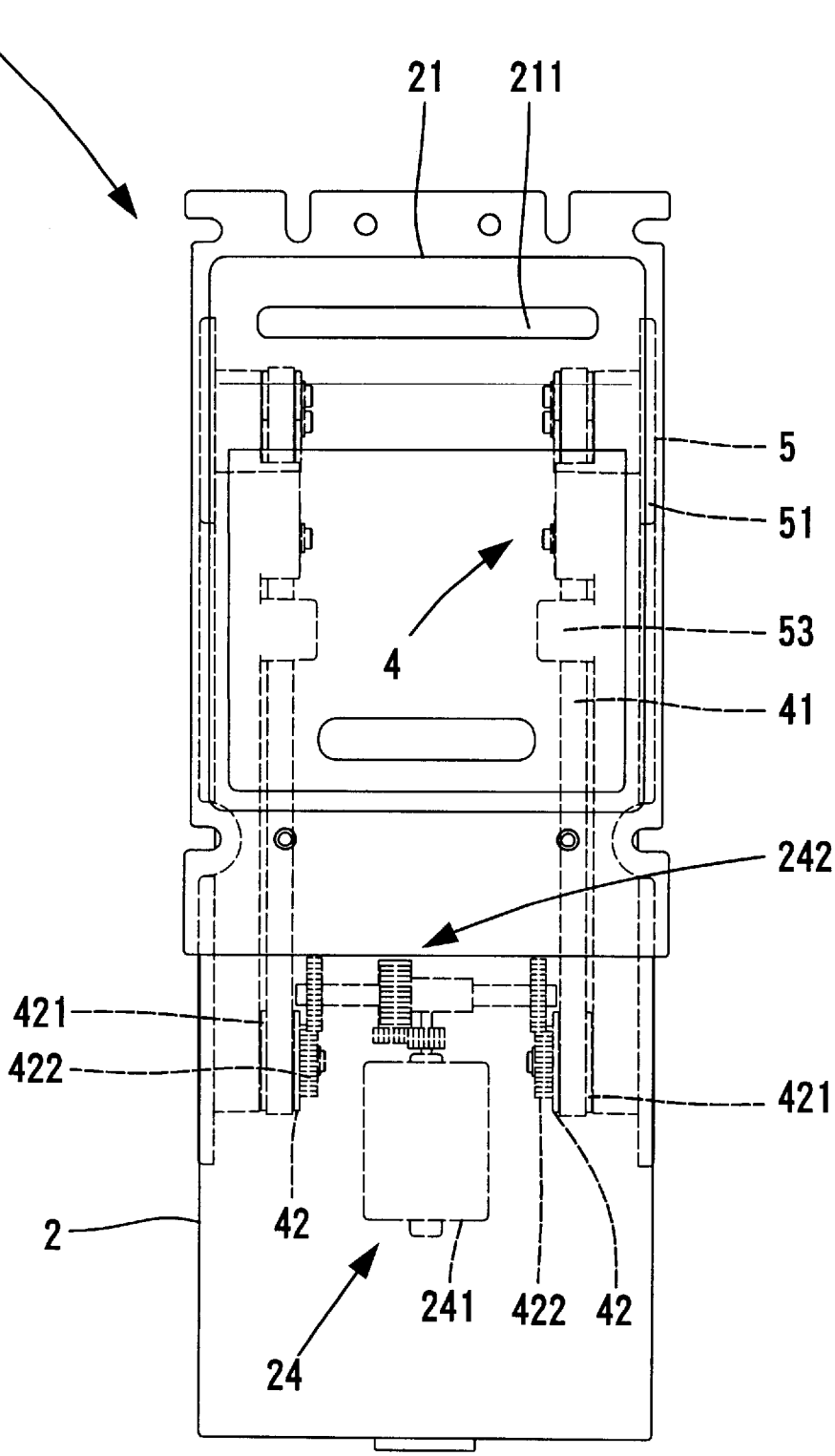
FIG. 5 is a rear view of the paper currency receiving device in accordance with the present invention.

Still referring to FIGS. 2 and 6, the drive wheel 42 in this embodiment is a dual wheel consisting of a first wheel 421 around which the belt 41 is mounted and a second wheel 422 in the form of a gear that is formed on a side of the first wheel 421 and coaxial with the first wheel 421. Referring to FIG. 5, a drive means 24 is provided for driving the second wheel 422 of each wheel assembly. In this embodiment, the drive means 24 includes a motor 241 and a gear train 242 that is connected to the second wheel 422 of each wheel assembly. Thus, when the paper currency receiving device 1 detects that a bill 6 is inserted into the bill-receiving opening 211, the motor 24 is activated to turn the second wheel 422 of each wheel assembly. Each wheel assembly is thus activated to feed the bill 6 inward, as shown in FIGS. 4 and 7.

Figure 3:
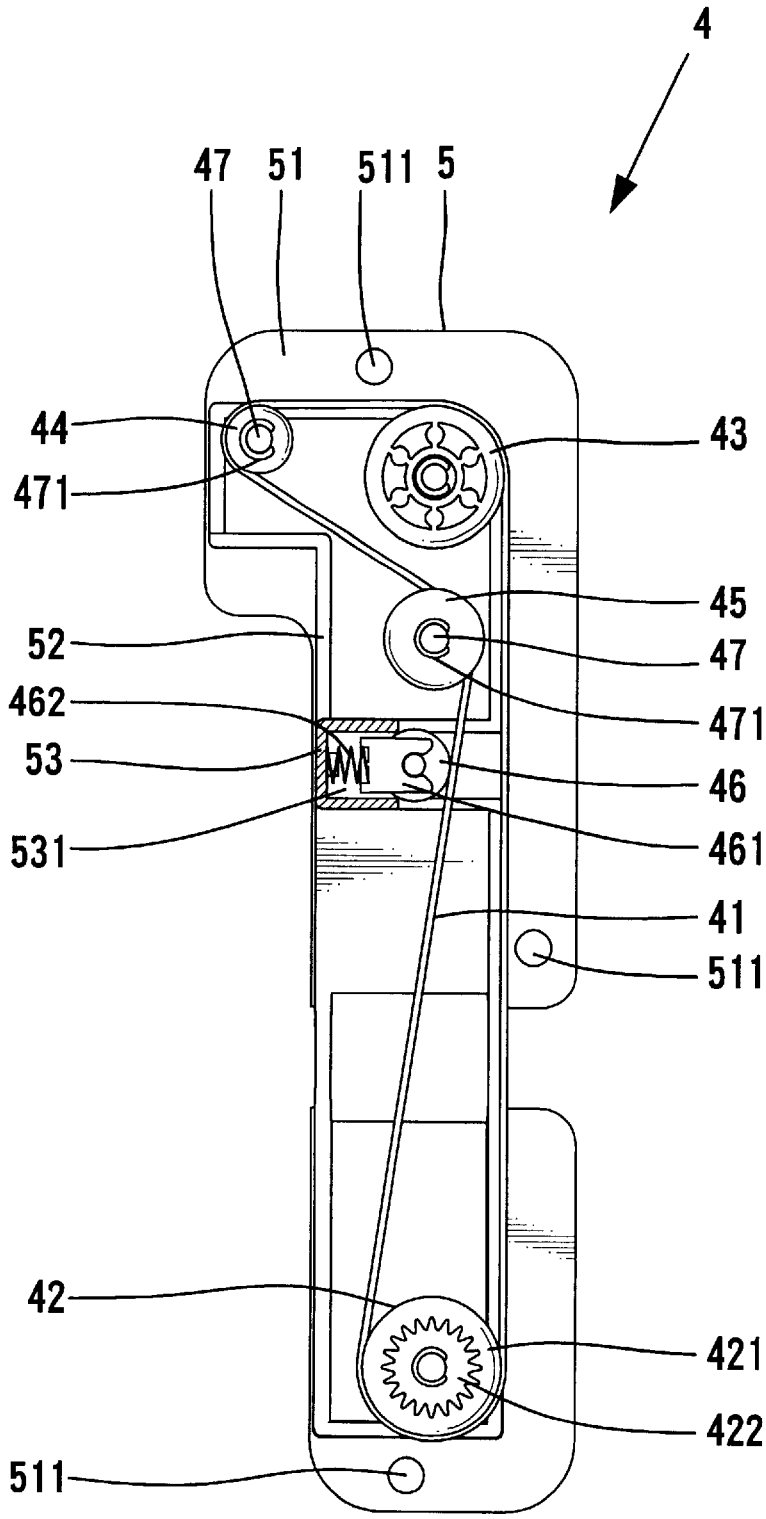
FIG. 3 is a side view, partly sectioned, of the wheel assembly module.

Referring to FIGS. 2 and 3, each plate 5 further includes a compartment 531 defined by a member 53. A movable block 461 is slidably mounted in the compartment 531 and biased by an elastic element 462 in the compartment 531 to a position shown in FIG. 3. An auxiliary tensioning wheel 46 is rotatably mounted to the movable block 461. When the belt 41 of the respective wheel assembly becomes loosened after a period of time, the auxiliary tensioning wheel 46 exerts the desired tensioning force on the belt 41 under the action of the elastic element 462. The service life of the belt 41 is thus prolonged.

According to the above description, it is appreciated that the wheel assembly modules 4 of the paper currency receiving device in accordance with the present invention can be easily detached from the body 2 of the paper currency receiving device for maintenance when desired. Thus, the wheel assembly 4 including the belt 41 can be cleaned or replaced when necessary. The risk of malfunction is thus reduced.

Although the invention has been explained in relation to its preferred embodiment, it is to be understood that many other possible modifications and variations can be made without departing from the scope of the invention as hereinafter claimed.

What is claimed is:

1. A paper currency receiving device comprising:

a body having two opposed sides each having an opening that communicates an interior of the body with outside, the body further having a bill-receiving opening in a front side thereof; and two wheel assembly modules respectively, detachably mounted to the openings of the body, each said wheel assembly module including a plate and a wheel assembly mounted on an inner side of the plate, the wheel assembly including a plurality of wheels and a belt mounted around the belt, said wheel assemblies feeding a bill inserted into the bill-receiving opening into the interior of the body.

2. The paper currency receiving device as claimed in claim 1, further including a box mounted to a rear of the body for receiving the bill fed into the interior of the body.

3. The paper currency receiving device as claimed in claim 1, wherein the openings are symmetrically defined in the opposed sides of the body.

4. The paper currency receiving device as claimed in claim 1, wherein the plate of each said wheel assembly module includes an engaging wall releasably engaged in an associated one of the openings of the body, with an associated one of the wheel assemblies being mounted inside the engaging wall.

5. The paper currency receiving device as claimed in claim 4, wherein engaging wall on the plate of each said wheel assembly module includes a plurality of pegs mounted therein, a plurality of axles being respectively mounted in the pegs, each of the wheels of the wheel assemblies of each said wheel assembly module being rotatably mounted on an associated one of the axles.

6. The paper currency receiving device as claimed in claim 5, wherein the wheels of the wheel assemblies of each said wheel assembly module includes a drive wheel that is driven by a drive means.

7. The paper currency receiving device as claimed in claim 6, wherein the wheels of the wheel assemblies of each said wheel assembly includes a tensioning wheel that exerts a tensioning force on the belt.

8. The paper currency receiving device as claimed in claim 7, wherein the plate of each said wheel assembly module includes a compartment for receiving an elastic element therein, a movable block being slidably received in the compartment, an auxiliary tensioning wheel being rotatably mounted to the movable block, the movable block being biased by the elastic element such that the auxiliary tensioning wheel exerts the tensioning force on the belt when the belt becomes loosened.

* * * * *